US005512989A

United States Patent [19]

Montfort

[11] Patent Number: 5,512,989

[45] Date of Patent: Apr. 30, 1996

[54] RESONATOR COUPLING COVER FOR USE IN ELECTROSTATOGRAPHIC APPLICATIONS

[75] Inventor: David B. Montfort, Penfield, N.Y.

[73] Assignee: Xerox Corporation, Stamford, Conn.

[21] Appl. No.: 332,316

[22] Filed: Oct. 31, 1994

[51] Int. Cl.[6] ..... G03G 15/14

[52] U.S. Cl. ..... 355/273; 310/322

[58] Field of Search ..... 355/271, 273, 355/274; 310/320–322, 325; 228/1.1

[56] References Cited

U.S. PATENT DOCUMENTS

| | | | |
|---|---|---|---|
| 4,111,546 | 9/1978 | Maret | 355/297 |
| 4,211,949 | 7/1980 | Brisken et al. | 310/322 |
| 4,987,456 | 1/1991 | Snelling et al. | 355/273 |
| 5,016,055 | 5/1991 | Pietrowski et al. | 355/273 |
| 5,081,500 | 1/1992 | Snelling | 355/273 |
| 5,357,324 | 10/1994 | Montfort | 355/273 |

*Primary Examiner*—William J. Royer
*Attorney, Agent, or Firm*—Denis A. Robitaille

[57] ABSTRACT

An apparatus for enhancing toner release from an image bearing member in an electrostatographic printing machine, including a resonator suitable for generating vibratory energy arranged in line contact with the back side of the image bearing member for uniformly applying vibratory energy to the image bearing member. The resonator includes a piezoelectric transducer and a waveguide assembly coupled to the transducer for directing high frequency vibratory energy to the image bearing member. A coupling cover is interposed between the waveguide assembly and the image bearing member with an adhesive layer situated between the coupling cover and the waveguide assembly for bonding the waveguide assembly to the coupling cover. In another embodiment, the resonator assembly includes a vacuum apparatus including a vacuum plenum defining an opening adjacent the image bearing member, the vacuum apparatus providing sufficient force at the vacuum plenum opening to draw the image bearing member toward the waveguide assembly and a coupling cover including a pair of resilient cap members, wherein each cap member is mounted on the vacuum plenum along the opening thereof so as to be interposed between the vacuum plenum and the image bearing member.

28 Claims, 4 Drawing Sheets

RESONATOR COUPLING COVER FOR USE IN ELECTROSTATOGRAPHIC APPLICATIONS

The present invention relates generally to an apparatus for applying vibratory energy to an imaging surface to enhance toner transfer in an electrostatographic printing machine and, more particularly, relates to a resonator cover arrangement for a high frequency resonator useful in applying vibratory energy to an imaging surface in electrostatographic applications.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing support surface, such as a photoreceptor, to a second support surface, such as a copy sheet or an intermediate transfer belt, is enabled by overcoming adhesion forces which hold toner particles to the image bearing surface. Typically, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. This corona discharge generates ions having a polarity opposite that of the toner particles, thereby electrostatically attracting and transferring the toner particles from the image bearing surface to the second support surface. An exemplary corotton ion emission transfer system is disclosed in U.S. Pat. No. 2,836,725.

Thus, the process of transferring development materials to a copy sheet in an electrostatographic printing system involves the physical detachment and transfer-over of charged toner particles from an image bearing surface to a second surface through the utilization of electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required in order to induce the physical detachment and transfer-over of the charged toner particles while maintaining the image configuration thereof and without scattering or smearing of the developer material.

The use of vibratory energy has been disclosed, for example in U.S. Pat. No. 3,854,974 to Sato, et al., among other U.S. Patents, as a method for enhancing electrostatic toner release from an image bearing surface. More recently, systems incorporating a resonator, suitable for generating focused vibratory energy, arranged along the back side of the image bearing surface for applying uniform vibratory energy thereto, have been disclosed. In such systems, toner transfer is enhanced due to the mechanical release of the toner particles from the image bearing surface so that effective toner transfer can occur despite the fact that electrostatic charges in the transfer zone may be insufficient to attract toner from the image bearing surface to the second support surface. Exemplary systems of this nature are disclosed in U.S. Pat. No. 4,987,456 to Snelling et al.; U.S. Pat. No. 5,005,054 to Stokes et al.; U.S. Pat. No. 5,010,369 to Nowak et al.; U.S. Pat. No. 5,016,055 to Pietrowski et al.; U.S. Pat. No. 5,081,500 to Snelling et al.; and U.S. Pat. No. 5,357,324, among other U.S. Patents. The contents of the identified patents are incorporated in their entirety by reference herein.

In systems which incorporate a resonator for applying uniform vibratory energy to the photoreceptor, it is necessary to provide proper coupling between the photoreceptor belt and the resonator tip in order to transmit identical sinusoidal motion from the resonator tip to the toner residing on the belt. Various arrangements for coupling a resonator to an image bearing surface such that vibratory motion can be applied thereto have been proposed. For example, as disclosed in U.S. Pat. No. 4,987,456, a resonator suitable for generating focused vibratory energy generally includes a resonating waveguide horn having a contacting tip which is brought into tension or penetration contact with the image bearing belt for coupling the vibratory motion to the belt. It has been shown that it may be desirable to provide widthwise slots along the length of the resonator horn so as to segment the resonator horn into individually vibrating portions. However, since such slots at the tip cannot exceed a maximum width without causing visible streaks and other image defects, expensive techniques such as precision Electronic Discharge Machining (EDM) must be utilized to provide this segmentation. Moreover, in spite of the use of expensive manufacturing processes, it has been noted that even with fully segmented horns, as shown in U.S. Pat. No. 5,025,291 to Nowak et al., there can be some segment-to-segment frequency response non-uniformity as well as a fall-off in response of the resonator at the outer edges of the device. In addition, nonuniform frequency response can result from improper alignment of each individual segment tip, a problem which can be traced back to the very notion of resonator segmentation.

The key to uniform vibration amplitudes across an ultrasonic resonator of the type used to enhance and enable electrophotographic processes is the decoupling of desired axial resonator motion (motion perpendicular to the charge retentive surface that caused toner release towards the final substrate) from undesirable transverse motion (motion in the cross process direction, parallel to the charge retentive surface). Even when resonator design parameters are optimized, transverse segmentation and discrete voltage modifications (as in U.S. Pat. No. 5,010,369 to Nowak et al., U.S. Pat. No. 5,025,291 to Nowak et al. and U.S. Pat. No. 5,210,577 to Nowak) will not completely eliminate this cross process direction non-uniformity. The root problem of non-uniformity is the mechanical continuum behavior in one dimension effecting behavior in other dimensions, requiring physical decoupling by segmenting the transducer. This minimizes, but alone cannot eliminate, the effect of the undesirable transverse modes along the length of the resonator, and maximizes axial transducer motion. Theoretically, a structure completely eliminating the transverse motion would provide discrete resonator segments. However, such a structure is not practical, since the vibratory energy of the resonator must somehow be coupled across the entire process width of the image bearing surface.

The problem of nonuniform frequency response in a resonator assembly and the concomitant image defects which may result therefrom is further exacerbated by the fact that proper coupling between the photoreceptor belt and the resonator tip is necessary for transmitting vibratory energy to the photoreceptor belt. That is, while it is necessary to provide a configuration in which there is direct contact between the resonator tip and the belt, a number of problems develop as a result of the direct contact between the resonator tip and the belt. For example, abrasive action caused by continuous motion of the belt against the resonator tip causes excessive wear and deterioration of the tip which, in turn, changes the resonant frequency of the resonator such that the resonator requires a tracking power supply, or a widened band width, to accommodate for this frequency shift. In addition, as the seam of the belt passes against the resonator tip, a significant torque spike is generated, causing abrupt vibration along the belt surface.

The present invention is directed toward various embodiments for a coupling cover for use in electrostatographic applications, wherein vibratory energy can be efficiently and effectively transmitted from a vibratory energy source to an imaging surface without the problems associated with prior art devices by bonding a resonator cover directly to the resonator waveguide. In addition to facilitating critical alignment specifications, the present invention minimizes undesirable cross process direction components of vibration by introducing a coupling cover to the interface between a resonator horn and the image bearing surface and additionally bonding the coupling cover to the resonator horn segments, thereby bridging the inter-segment gaps. Thus, by bonding the resonator horn to the coupling cover, the horn segments will tend to move with the coupling cover and in phase with one another when the resonator vibrates in the axial direction. A first embodiment incorporates a piezoelectric transducer in combination with a waveguide horn, wherein a coupling cover is bonded to the exposed end of the waveguide horn in order to eliminate the problems found in prior art devices. In another embodiment, the resonator assembly includes a vacuum apparatus including a vacuum plenum defining an opening adjacent the image bearing member, the vacuum apparatus providing sufficient force at the vacuum plenum opening to draw the image bearing member toward the waveguide member and a coupling cover including a pair of resilient cap members, each cap member being mounted on the vacuum plenum along the opening thereof so as to be interposed between the vacuum plenum and the image bearing member.

The following disclosures may be relevant to various aspects of the present invention:

U.S. Pat. No. 4,111,546, Patentee: Maret, Issued: Sep. 5, 1978

U.S. Pat. No. 4,987,456, Patentee: Snelling, et al., Issued: Jan. 22, 1981

U.S. Pat. No. 5,016,055, Patentee: Pietrowski, et al., Issued: May 14, 1991

U.S. Pat. No. 5,081,500, Patentee: Snelling, Issued: Jan. 14, 1992

U.S. Pat. No. 5,357,324, Patentee: Montfort, Issued: Oct. 18, 1994

The relevant portions of the foregoing disclosures may be briefly summarized as follows:

U.S. Pat. No. 4,111,546 discloses enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (piezoelectric element) at a frequency in the range of about 20 kilohertz.

U.S. Pat. No. 4,987,456 discloses a resonator suitable for generating vibratory energy arranged in live contact with the back side of a charge retentive imaging member for uniformly applying vibratory energy thereto. The resonator includes a vacuum producing element, a vibratory member, and a seal arrangement, whereby a vacuum is applied at the point of contact with the charge retentive surface to draw the surface into intimate contact engagement with the vibratory member.

U.S. Pat. No. 5,016,055 to Pietrowski et al. and U.S. Pat. No. 5,081,500 disclose a method and apparatus for using vibratory energy in combination with the application of a transfer field for enhanced transfer in electrophotographic imaging. An electrophotographic device, including a flexible belt-type transfer member or a sheet of paper is brought into intimate contact with a charge retentive member bearing a developed latent image at a transfer station for electrostatic transfer of toner from the charge retentive surface to the sheet. At the transfer station, a resonator suitable for generating vibratory energy is arranged in line contact with the back side of the charge retentive surface for uniformly applying vibratory energy to the charge retentive member such that toner will be released from the forces adhering it to the charge retentive surface at the line contact position by means of electrostatic and mechanical forces. In those areas characterized by non-intimate contact of the sheet with the charge retentive surface, toner is transferred across the gap by the combination of vibratory energy and the electrostatic transfer process, despite the fact that the charge on the paper would not normally be sufficient to attract toner to the sheet from the charge retentive surface.

U.S. Pat. No. 5,357,324 discloses an apparatus for enhancing transfer of a developed toner image from an image bearing member to a support substrate an electrostatographic printing machine including a resonator suitable for generating vibratory energy arranged in line contact with the back side of the image bearing member for uniformly applying vibratory energy to the image bearing member. The toner release enhancing system includes a vacuum plenum substantially enclosing the resonator and defining an opening adjacent the image bearing member, wherein a vacuum source provides sufficient force at the vacuum plenum opening to draw the image bearing member toward the resonator. A replaceable coupling cover is also provided for mounting on the vacuum plenum, in alignment with the opening defined thereby, to couple the resonator to the image bearing member, wherein a simple and inexpensive replaceable protective coupling attachment extends the functional life of the resonator, and in particular, the horn thereof and also tends to optimize the region in which vibratory energy is delivered to the image bearing member by dampening the vibration of the belt outside of the transfer region.

In accordance with one aspect of the present invention, there is provided a resonator assembly for applying uniform vibratory energy to an adjacent surface, comprising: a vibratory energy producing element for generating the vibratory energy; a waveguide member coupled to the vibratory energy producing element for directing the high frequency vibratory energy to the adjacent surface; a coupling cover interposed between the vibratory energy producing element and the adjacent surface; and an adhesive layer situated between the vibratory energy producing element and the waveguide member for providing an adhesive bond therebetween.

In accordance with another aspect of the present invention, a system for enhancing transfer of toner from an image bearing member is provided, comprising: means for applying vibratory energy to the image bearing member; a cover member interposed between the vibratory energy applying means and the image bearing member; vacuum means for drawing the image bearing member toward the cover member; and an adhesive layer situated between the vibratory energy applying means and the cover member for providing an adhesive bond therebetween.

In accordance with yet another aspect of the present invention, an electrostatographic printing apparatus, including a system for enhancing transfer of toner particles from an image bearing member is provided, including a resonator assembly for applying uniform vibratory energy to the image bearing member, comprising: a vibratory energy producing element for generating the vibratory energy; a waveguide member coupled to the vibratory energy producing element for directing the high frequency vibratory energy to the adjacent surface; a coupling cover interposed between the vibratory energy producing element and the adjacent surface; and an adhesive layer situated between the vibratory energy producing element and the adjacent surface for providing an adhesive bond therebetween.

In a further aspect of the present invention, there is provided a resonator assembly for applying uniform vibratory energy to an image bearing member, comprising: a vibratory energy producing element for generating the vibratory energy; a waveguide member coupled to the vibratory energy producing element for directing the high frequency vibratory energy to the image bearing member; a vacuum apparatus including a vacuum plenum defining an opening adjacent the image bearing surface, wherein the vacuum apparatus provides sufficient force at the vacuum plenum opening to draw the image bearing member toward the waveguide member; and a coupling cover including a pair of resilient cap members, wherein each cap member is mounted on the vacuum plenum along the opening thereof so as to be interposed between the vacuum plenum and the image bearing member.

In a further aspect of the present invention, there is provided a system for enhancing transfer of toner from an image bearing member, comprising: means for applying vibratory energy to the image bearing member; vacuum means including a vacuum plenum including a pair of wall members having the waveguide member interposed therebetween, the wall members extending to a substantially common plane to define an opening adjacent the image bearing member, wherein the vacuum means provides sufficient force at the vacuum plenum opening to draw the image bearing member toward the vibratory energy applying means; and a cover member including a pair of resilient cap members, wherein each cap member is mounted on the vacuum plenum along the opening thereof so as to be interposed between the vacuum plenum and the image bearing member.

In yet a further aspect of the present invention, there is provided an electrostatographic printing apparatus including a system for enhancing transfer of toner particles from an image bearing member, including a resonator assembly for applying uniform vibratory energy to the image bearing member, comprising: a vibratory energy producing element for generating the vibratory energy; a waveguide member coupled to the vibratory energy producing element for directing the high frequency vibratory energy to the image bearing member; a vacuum apparatus including a vacuum plenum defining an opening adjacent the image bearing surface, wherein the vacuum apparatus provides sufficient force at the vacuum plenum opening to draw the image bearing member toward the waveguide member; and a coupling cover including a pair of resilient cap members, wherein each cap member is mounted on the vacuum plenum along the opening thereof so as to be interposed between the vacuum plenum and the image bearing member.

These and other aspects of the present invention will become apparent from the following description in conjunction with the accompanying drawings, in which.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

Figure 4:
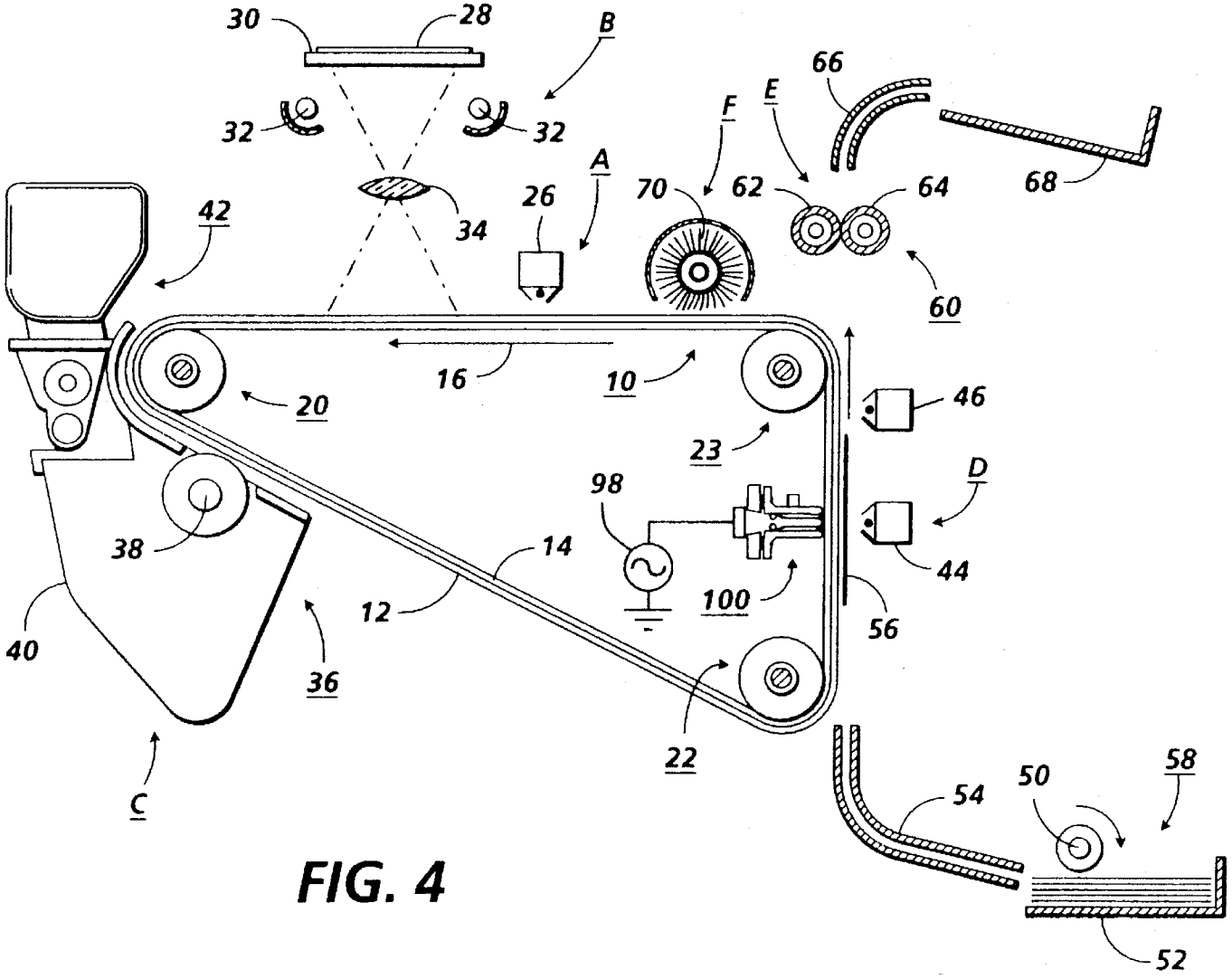
FIG. 4 is a schematic side view of an illustrative electrophotographic reproducing machine including an exemplary transfer station having the resonator with a vacuum plenum and coupling cover arrangement as shown in FIGS. 1–3.

For a general understanding of an exemplary printing machine incorporating the features of the present invention, a schematic depiction of the various processing stations, and the machine components thereof, is provided in FIG. 4. Although the vacuum plenum and coupling cover arrangement of the present invention is particularly well adapted for use with a transfer subsystem in an automatic electrophotographic reproducing machine as shown in FIG. 4, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example. It will be further appreciated that the present invention is not necessarily limited to the particular embodiment or embodiments shown and described herein.

Thus, prior to discussing the features and aspects of the present invention in detail, a schematic depiction of an exemplary electrophotographic reproducing machine incorporating various subsystems is furnished in FIG. 4, wherein an electrophotographic reproducing apparatus employs a belt 10, including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a developer roll 38 disposed in a developer housing 40. Toner particles are mixed with carrier beads in the developer housing 40, generating an electrostatic charge which causes the toner particles to cling to the carrier beads, thereby forming the developing material. The magnetic developer roll 38 is rotated in the developer housing 40 to attract the developing material to form a "brush" comprising the developer roll 38 with carrier beads with toner particles magnetically attached thereto. As the developer roll 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy sheet or substrate, is moved into contact with the developed toner image on belt 10 via sheet feeding apparatus 58 and chute 54 for synchronously placing the support material 56 into contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the support material 56 while the support material 56 is also electrostatically tacked to photoreceptor belt 10.

With particular reference to the principle of enhanced toner release as provided by a vibratory energy assisted transfer system, the exemplary transfer station D of FIG. 4 includes a vibratory energy producing device or resonator 100 which may include a relatively high frequency acoustic or ultrasonic transducer driven by an AC voltage source 98. The resonator 100 is arranged in vibratory relationship with the back side of belt 10 at a position corresponding to the location of corona generating device 44 for applying vibratory energy to the belt 10 and for agitating the toner developed in imagewise configuration thereon to provide mechanical release of the toner particles from the surface of the belt 10. Such vibratory energy enhances toner transfer by dissipating the attractive forces between the toner particles and the belt 10. In a preferred arrangement, the resonator 100 is configured such that the vibrating surface thereof is parallel to photoconductive belt 10 and transverse to the direction of belt movement 16, with a length approximately coextensive with the belt width. The belt 10 has the characteristic of being nonrigid, or somewhat flexible, to the extent that it can be effected by the vibrating motion of the resonator 100, thereby providing mechanical release of the toner from the surface of belt 10 and allowing more efficient electrostatic attraction of the toner to a copy sheet during the transfer step. Vibratory assisted transfer, as provided by transducer 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems are described in U.S. Pat. Nos. 4,987,456, 5,016,055 and 5,081,500, among various other commonly assigned patents, which are incorporated in their entirety by reference into the present application for patent. Further details of vibratory assisted toner release in electrostatographic applications can also be found in an article entitled "Acoustically Assisted Xerographic Toner Transfer", by Crowley, et al., published by The Society for Imaging Science and Technology (IS&T) Final Program and Proceedings, 8th International Congress on Advances in Non-Impact Printing Technologies, Oct. 25–30, 1992. The contents of that paper are also incorporated by reference herein.

Continuing with a description of the exemplary electrophotographic printing process, after the transfer step is completed, a corona generator 46 charges the support material 56 with an opposite polarity to release the support material from belt 10, whereupon the support material 56 is stripped from belt 10. The support material 56 is subsequently separated from the belt 10 and transported to a fusing station E. It will be understood by those of skill in the art, that the support material may also be an intermediate surface or member, which carries the toner image to a subsequent transfer station for transfer to a final support surface. These types of surfaces are also charge retentive in nature. Further, while belt type members are described herein, it will be recognized that other substantially nonrigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support material 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor, paper delivery, xerographic processing functions associated with developing and transferring the developed image onto the paper, and various functions associated with copy sheet transport and subsequent finishing processes. As such, the controller initiates a sequencing schedule which is highly efficient in monitoring the status of a series of successive print jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown) coupled to the controller.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 1:
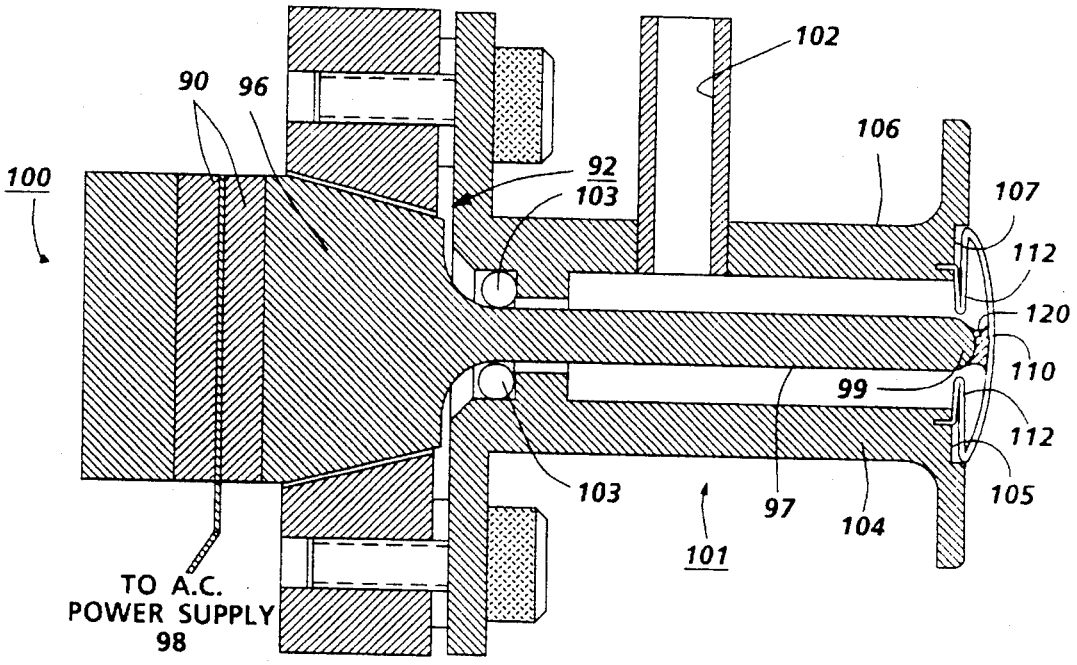
FIG. 1 is a cross sectional view of a typical transducer/vacuum plenum arrangement incorporating a resonator coupling cover in accordance with the present invention.

With particular reference to FIG. 1, and as previously discussed, the principle of enhanced toner release as provided by the vibratory energy assisted transfer system described hereinabove is facilitated by a relatively high frequency acoustic or ultrasonic resonator 100 situated substantially in contact with the back side of belt 10, at a position in alignment with corona generating device 44. The resonator 100, which may include a piezoelectric transducer 90 driven by an A.C. voltage source 98, is generally operated at a frequency between 20 kHz and 200 kHz and typically at approximately 60 kHz. A horn or waveguide member 92 is coupled to the piezoelectric transducer 90 for transmitting the vibratory energy emitted therefrom to the belt 10. An adhesive epoxy and conductive mesh layer or other materials may be used to bond the transducer and waveguide elements together without the requirement of a backplate or other mechanical coupling devices.

The waveguide member 92 is preferably fabricated from aluminum, having a platform portion 96, a horn element 97 and a contacting tip 99 for contacting belt 10 to impart the vibratory energy of the transducer 90 thereto. Various shapes and structures have been considered for the waveguide member 92, as discussed in U.S. Pat. No. 4,987,456. While a "stepped horn" waveguide is shown, it will be understood that other shapes, such as an exponential shape, a conical shape, or the like may also be employed.

The resonator assembly 100 is configured in association with a vacuum plenum 101 arrangement, including a vacuum supply 102 (vacuum source not shown) and a resonator coupling cover 110, which may be of a type disclosed in U.S. Pat. No. 5,357,324. In this arrangement, the horn 92 is enclosed by a generally air tight vacuum plenum 101 defined by upstream and downstream walls 104 and 106, respectively. The vacuum plenum 101 is sealed at either end along the marginal edges of the belt 10 at inboard and outboard sides thereof (not shown), with mounting blocks connected to wails 104, 106. The interface between the horn 92 and the vacuum plenum 101 is sealed with an elastomer sealing member 103, which also serves to isolate the vibration of the horn 92 from walls 104 and 106. Walls 104 and 106 are approximately parallel to the horn body, extending to a common plane and together forming an opening in the vacuum plenum 101 adjacent to the photoreceptor belt 10. The resonator coupling cover 110 is mounted in this opening, forming an interface between the contacting tip 99 of the horn 92 and the belt 10. The tip 99 may be colinear with, or may slightly extend just beyond the plane formed by walls 104, 106 such that the resonator coupling cover 110 is bowed slightly, creating a colinear or concave profile at the interface with belt 10.

Vacuum plenum 101 is coupled to a vacuum or negative air pressure source such as a diaphragm pump or a blower (not shown) via outlet 102 formed in one or more locations along the length of upstream or downstream walls 104 and 106, respectively. When negative air pressure is applied to the vacuum plenum 101 via outlet 102, belt 10 is drawn into contact with the resonator coupling cover 110 so that horn 92 imparts the vibratory energy of the resonator 100 to belt 10 via the resonator coupling cover 110. This arrangement provides positive contact engagement between the resonator 100 and the photoreceptor belt 10 while maintaining continuity along the region of contact between the resonator 100 and the belt 10, without regard for whether the contacting tip 99 of the horn element 97 is flat, curved and/or segmented. The coupling cover also provides a replaceable protective coupling attachment for extending the functional life of the resonator 100, and in particular, the horn thereof, as well as the life of the photoreceptor belt 10. The resonator coupling cover 110 advantageously protects the resonator from wear and minimizes the photoreceptor torque spike occurring from contact with the seam of the photoreceptor belt 10 while enhancing toner release provided by the vibratory energy assisted transfer system by creating a damping effect for eliminating image quality defects caused by perturbation of vibrational energy outside the region of transfer. The particular features of the resonator coupling cover and horn, as well as various embodiments therefor as contemplated by the present invention will discussed in greater detail hereinbelow.

The resonator coupling cover 110 may be embodied in many various forms and configurations and may be provided via numerous materials. In one embodiment, as shown in FIG. 1, which has been shown to be particularly functional, the coupling cover is fabricated from flexible, wear resistant material, for example, a strip of bronze metal, approximately 0.004 inches in thickness. This metal strip is provided with folded wing segments 112, formed by way of typical metal bending techniques, for creating resilient mounting elements along the marginal edges of the coupling cover for being inserted into receiving tracks 105 and 107 formed in the walls 104 and 106 of the vacuum plenum 101. Mounting clips (not shown) may also be provided for supporting the marginal edges of the coupling cover in the receiving tracks 105, 107. In a preferred embodiment, it has been shown that it may be advantageous to have the coupling cover protrude slightly above the plane formed by the air plenum walls 104, 106 such that the surface profile of the air plenum/coupling cover arrangement is concave, protruding slightly toward the region of contact with the photoreceptor belt 10, while being maintained in contact with the tip 99 of horn 92. It has been found that this concave surface profile provides a geometry which reduces friction in the contact region between the belt 10 and the resonator 100 by eliminating "belt wrap-over" from occurring between the dynamic photoreceptor belt and the horn 92 and the inside edges of walls 104 and 106 which has been known to occur in configurations which do not include the coupling cover of the present invention. In addition, this geometry has been shown to advantageously reduce surface disturbance in the belt seam contact region and thereby minimizes the motion torque spike caused by contact with the belt seam customarily associated with vibratory energy assisted transfer systems. It will be understood, however, that the tip 99 of horn 92 may be substantially coplanar with the opening formed by walls 104, 106 such that the coupling cover and the overall surface profile of the resonator cover is substantially flat. Alternatively, the surface profile may even be convex, forming a valley adjacent the contacting tip 99, as desired.

It is noted that the coupling cover 110 may also be provided with a series of vacuum ports 114 in the form of a plurality of apertures formed along the length of the metal strip making up the cover and being situated on either side of the contacting tip 99 of horn 92 when mounted adjacent thereto, as shown in U.S. Pat. No. 5,357,324. The vacuum ports 114 permit air flow through the coupling cover 110 for creating the advantageous coupling engagement between the resonator 100 and the photoreceptor belt 10. It should be understood that the apertures defining the vacuum ports 114 may be formed so as to reduce belt wear; for example, as a series of elliptically or triangularly shaped apertures. It will also be understood that the resonator coupling cover of this embodiment may be fabricated from various materials, not limited to metals, and that such materials may also be advantageously coated with a various coating materials, as for example, an electrodeposited layer of metallic chromium, which may provide a reduced surface energy for reducing friction forces between the cover 110 and the belt 10.

As previously discussed, systems incorporating a resonator for applying uniform vibratory energy to the photoreceptor belt typically provide widthwise slots along the length of the horn so as to segment the horn into individually vibrating portions, thereby decoupling desired axial resonator motion from undesirable transverse motion. However, such segmentation can generate nonuniform segment-to-segment frequency response as well as a fall-off in response of the resonator at the outer edges of the device. In addition, segmentation may also lead to improper alignment of individual segment tips, which may also result in nonuniform frequency response along the length of the resonator. Further still, a number of problems develop as a result of the direct contact between the contacting tip and the belt.

Figure 2:
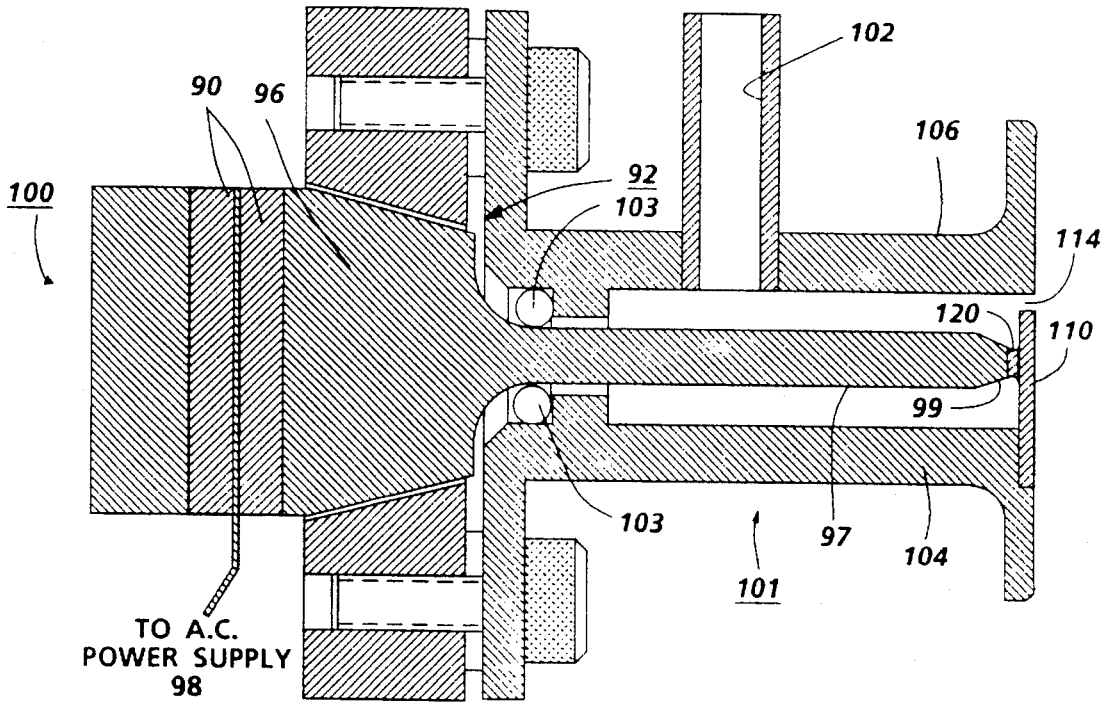
FIG. 2 is a cross sectional view of an alternative embodiment for a transducer/vacuum plenum arrangement incorporating a resonator coupling cover in accordance with the present invention.
Figure 3:
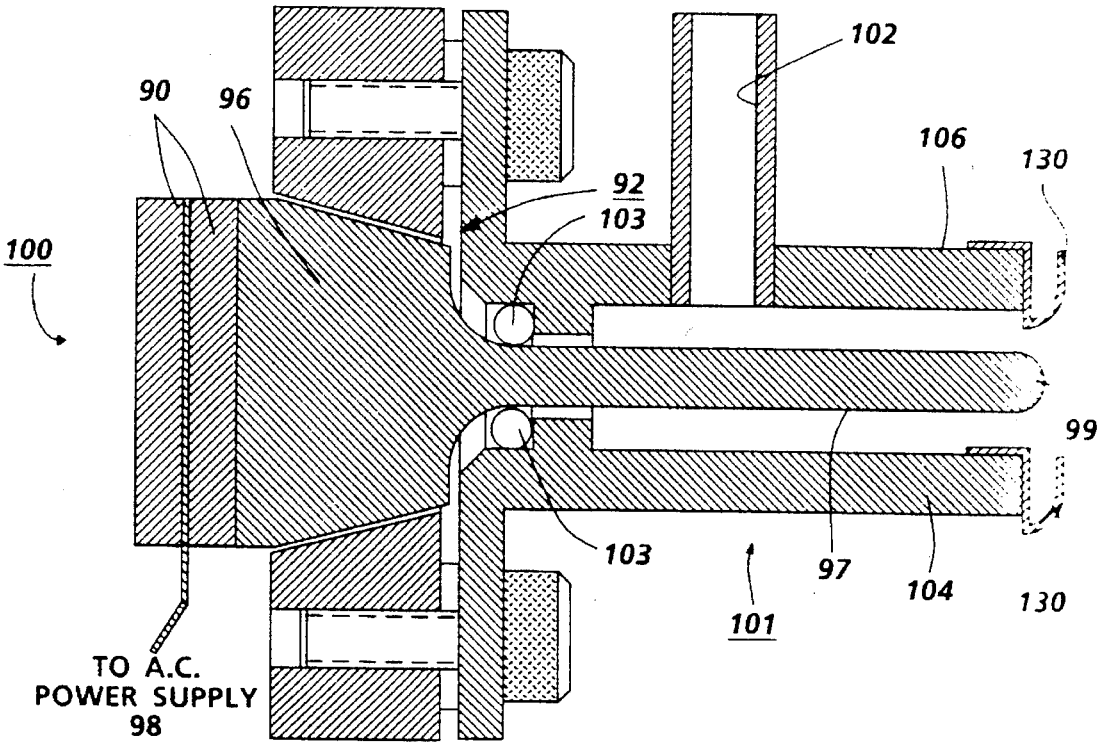
FIG. 3 is is a cross sectional view of an alternative embodiment for a resonator coupling cover in accordance with the present invention.

The present invention is directed to correcting the problems associated with resonator segmentation in a vacuum plenum/resonator arrangement as described herein by providing an adhesive bond layer between the segmented resonator and the resonator coupling cover. The additional bonding layer provides a vehicle for aligning the tips of the horn with respect to the coupling cover, while dampening undesirable cross-process vibratory energy exiting therefrom so as to produce more uniform frequency response along the length of the resonator. Referring to FIGS. 1–3, an adhesive layer 120 (not shown to scale) is sandwiched between the resonator coupling cover 110 and the waveguide member 92 adjacent to the tip 99 thereof. The adhesive layer 120 is comprised of an adhesive material such as epoxy. An exemplary bonded resonator/coupling cover assembly in accordance with the present invention which has proven to provide satisfactory results was fabricated using a two-part epoxy mixture comprised of a 100 to 16 ratio of A24 adhesive mixed with 24LV hardener, distributed by Emerson and Cumming, Inc. This ratio provides a relatively low modulus of elasticity on the order of $15\times10^3$ psi. Preferably the adhesive layer has a thickness of approximately 65 microns. During fabrication, the assembly is clamped together at approximately 300 psi to ensure good flow of the epoxy to all surfaces.

An alternative embodiment that has also been shown to be functional is shown in FIG. 2, wherein a thin strip of Mylar or other flexible elastomeric material is mounted. The Mylar strip has a thickness on the order of approximately 0.005 inches and is mounted, via adhesive or other means, in a single channel formed in the upstream wall 104 of the vacuum plenum 101. The width of this Mylar strip is less than the dimension separating walls 104 and 106 at the opening formed thereby such that an air gap is formed between the coupling cover 110 and the downstream wall 106, providing a vacuum port for allowing air to flow therethrough. Obviously, this embodiment eliminates the necessity of forming a plurality of apertures in the resonator cover 110, while allowing a vacuum to be pulled along the gap between the coupling cover 110 and the wall of the vacuum plenum 101. This alternative embodiment shows an example of a configuration in which the surface profile of the resonator/vacuum plenum arrangement is substantially flat, as previously discussed. In accordance with the present invention an adhesive material 120 is placed in the narrow gap defined by the resonator coupling cover 110 and the tip 99 of the horn 92. Another suitable exemplary adhesive material may include a viscoelastic material such as Dow Corning 732 RTV sealant. Undesirable cross process direction components of vibration can be attenuated by introducing such an adhesive material to the interface defined by the resonator cover and the tip of the resonator horn. As a result, when the resonator vibrates in the axial direction, the horn elements will tend to move in phase with one another. While overall magnitude of transducer response is lower, the variation in response across the resonator is markedly more uniform. Moreover, by bonding the contacting tip to the coupling cover, proper alignment of the contacting tip 99 with respect to the walls 104 and 106 is facilitated and maintained.

Yet another embodiment of a resonator cover which may be employed advantageously in a vibratory assisted transfer system of the type described herein is shown in FIG. 3. In this embodiment, a pair of flexible, energy absorbing cap members 130 are attached to walls 104 and 106 of the vacuum plenum 101 at a position adjacent to the photoreceptor belt. The cap members 130 are fabricated from a low mass, resilient material, preferably a spring stainless steel, having a thickness of approximately 0.0035 inches, for effectively providing a self-aligning spring loaded surface to act as a sacrificial wear surface which contacts the moving photoreceptor belt and acts to dampen belt vibration by insuring contact with the belt. This embodiment permits relaxation of critical dimensional tolerances while eliminating many critical tolerance problems associated with aligning three surfaces coplanar over the entire process width within a ±0.005" tolerance. Further, this resilient, low mass cap assembly absorbs the impact energy generated by the belt seam impacting the plenum housing and thus minimizes the torque spike generated therefrom. Hence, motion quality disturbances are minimized, yielding improved vibration control and eliminating belt velocity transients.

With reference again to FIG. 4, it will no doubt be appreciated that the inventive resonator coupling cover arrangement has equal application in the cleaning station of an electrophotographic device with little variation. Accordingly, a resonator assembly in accordance with the present invention may be arranged in close relationship to the cleaning station F, for the mechanical release of toner from the surface prior to cleaning. Additionally, it will be understood by those of skill in the art that improvement in preclean treatment may occur with application of vibratory energy simultaneously with preclean charge leveling. The invention finds equal application in this application.

In review, the present invention describes a resonator coupling cover mounting for use in electrostatographic applications. In a first embodiment the resonator coupling cover assembly is fabricated by means of a bonded construction, wherein an adhesive layer is sandwiched between the resonator and the coupling cover. On a second embodiment, the coupling cover is bonded to a vacuum plenum apparatus surrounding the resonator for transferring any impact forces to the coupling cover instead of the resonator tip. The particular vacuum coupled resonator arrangement of the present invention permits the application of high frequency acoustic or ultrasonic energy to a belt to deliver vibratory energy thereto while restricting the application of vibratory energy to a defined region. Notably, it has been found that application of vibratory energy outside the transfer field tends to cause greater electromechanical adherence of toner to the belt surface, creating a problem for subsequent transfer or cleaning. It is noted that the bonded resonator coupling cover arrangement of the present invention also tends to dampen the vibration of the belt outside of the region in which vibration is desired, resulting in a focused area of agitation whereby the vibratory energy imparted to the belt does not disturb a developed image thereon prior to the optimal transfer region or induce back transfer at a post transfer region.

It is, therefore, evident that there has been provided, in accordance with the present invention, a resonator assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

I claim:

1. A resonator assembly for applying uniform vibratory energy to an adjacent surface, comprising:

a vibratory energy producing element for generating the vibratory energy;

a waveguide member coupled to said vibratory energy producing element for directing the vibratory energy to the adjacent surface;

a coupling cover interposed between said vibratory energy producing element and the adjacent surface; and an adhesive layer situated between said waveguide member and said coupling cover for providing an adhesive bond therebetween.

2. The resonator assembly of claim 1, wherein said adhesive layer comprises an epoxy material.

3. The resonator assembly of claim 1, wherein said adhesive layer has a modulus of elasticity of approximately $15\times10^3$ psi.

4. The resonator assembly of claim 3, wherein said adhesive layer has a thickness no greater than approximately 65 microns.

5. The resonator assembly of claim 1, wherein said vibratory energy producing element includes a piezoelectric transducer.

6. The resonator assembly of claim 1, further including a voltage source for driving said vibratory energy producing element.

7. The resonator assembly of claim 1, further including a vacuum apparatus for drawing the adjacent surface toward said resonator assembly.

8. The resonator assembly of claim 1, wherein said waveguide member is segmented into a plurality of waveguide segments along a longitudinal axis thereof.

9. A system for enhancing transfer of toner from an image bearing member, comprising:

means for applying vibratory energy to the image bearing member;

a cover member interposed between said vibratory energy applying means and the image bearing member;

vacuum means for drawing the image bearing member toward said cover member; and an adhesive layer situated between said vibratory energy applying means and said cover member for providing an adhesive bond therebetween.

10. The system of claim 9, wherein said adhesive layer comprises an epoxy material.

11. The system of claim 9, wherein said adhesive layer has a modulus of elasticity of approximately $15\times10^3$ psi.

12. The system of claim 9, wherein said means for applying vibratory energy includes:

a piezoelectric transducer for generating vibratory energy; and a waveguide member adapted to direct the vibratory energy generated by said piezoelectric transducer to said image bearing member.

13. The system of claim 9, wherein said vacuum means includes a vacuum plenum defining an opening adjacent the image bearing member, wherein said vacuum means provides sufficient force at said vacuum plenum opening to draw the image bearing member toward said cover member.

14. The system of claim 13, wherein said cover member defines an aperture for permitting airflow into the vacuum plenum through the opening defined thereby.

15. The system of claim 13, wherein said vacuum plenum includes a pair of wall members having said waveguide member interposed therebetween, said wall members extending to a substantially common plane for defining the vacuum plenum opening.

16. The system of claim 15, wherein at least one of said wall members includes a vacuum port for coupling said vacuum plenum to said vacuum means.

17. The system of claim 9, further including means for electrostatically attracting the toner from the image bearing member.

18. The system of claim 9, wherein said vibratory energy applying means is segmented into a plurality of waveguide segments along a longitudinal axis thereof.

19. An electrostatographic printing apparatus including a system for enhancing transfer of toner particles from an image bearing member, including a resonator assembly for applying uniform vibratory energy to the image bearing member, comprising:

a vibratory energy producing element for generating the vibratory energy;

a waveguide member coupled to said vibratory energy producing element for directing the vibratory energy to the image bearing member;

a coupling cover interposed between said vibratory energy producing element and the image bearing member; and an adhesive layer situated between said vibratory energy producing element and the image bearing member for providing an adhesive bond therebetween.

20. The electrostatographic printing apparatus of claim 19, wherein said adhesive layer comprises an epoxy material.

21. The electrostatographic printing apparatus of claim 19, wherein said adhesive layer has a modulus of elasticity of approximately $15\times10^3$ psi.

22. The electrostatographic printing apparatus of claim 19, wherein said waveguide member is segmented into a plurality of waveguide segments along a longitudinal axis thereof.

23. The electrostatographic printing apparatus of claim 19, further including means for electrostatically attracting the toner particles from the image bearing member to an adjacent surface.

24. The electrostatographic printing apparatus of claim 23, wherein said vibratory energy producing element and said electrostatic attracting means are in substantial alignment with one another.

25. A resonator assembly for applying uniform vibratory energy to an image bearing member, comprising:

a vibratory energy producing element for generating the vibratory energy;

a waveguide member coupled to said vibratory energy producing element for directing the vibratory energy to the image bearing member;

a vacuum apparatus including a vacuum plenum defining an opening adjacent the image bearing member, wherein said vacuum apparatus provides sufficient force at said vacuum plenum opening to draw the image bearing member toward said waveguide member; and a coupling cover including a pair of resilient cap members, wherein each cap member is mounted on said vacuum plenum along the opening thereof so as to be interposed between the vacuum plenum and the image bearing member.

26. A system for enhancing transfer of toner from an image bearing member, comprising:

means for applying vibratory energy to the image bearing member;

vacuum means including a vacuum plenum including a pair of wall members having said vibratory energy applying means interposed therebetween, the wall members extending to a substantially common plane to define an opening adjacent the image bearing member, wherein said vacuum means provides sufficient force at said vacuum plenum opening to draw the image bearing member toward said vibratory energy applying means; and a cover member including a pair of resilient cap members, wherein each cap member is mounted on said vacuum plenum along the opening thereof so as to interposed between the vacuum plenum and the image bearing member.

27. The system of claim 26, wherein at least one of said wall members includes a vacuum port for coupling said vacuum plenum to an airflow source.

28. An electrostatographic printing apparatus including a system for enhancing transfer of toner particles from an image bearing member, including a resonator assembly for applying uniform vibratory energy to the image bearing member, comprising:

a vibratory energy producing element for generating the vibratory energy;

a waveguide member coupled to said vibratory energy producing element for directing the vibratory energy to the image bearing member;

a vacuum apparatus including a vacuum plenum defining an opening adjacent the image bearing member, wherein said vacuum apparatus provides sufficient force at said vacuum plenum opening to draw the image bearing member toward said waveguide member; and a coupling cover including a pair of resilient cap members, wherein each cap member is mounted on said vacuum plenum along the opening thereof so as to interposed between the vacuum plenum and the image bearing member.

* * * * *